US007131147B2

(12) United States Patent
Villegas

(10) Patent No.: US 7,131,147 B2
(45) Date of Patent: Nov. 7, 2006

(54) PLEATED SKIRT

(76) Inventor: Steven Jeffrey Villegas, 1819 15th Ave. W., Seattle, WA (US) 98119

( * ) Notice: Subject to any disclaimer, the term of this patent is extended or adjusted under 35 U.S.C. 154(b) by 0 days.

(21) Appl. No.: 10/890,834

(22) Filed: Jul. 14, 2004

(65) Prior Publication Data

US 2006/0010570 A1 Jan. 19, 2006

(51) Int. Cl.
*A41D 1/14* (2006.01)

(52) U.S. Cl. ..... 2/211; 2/219; 2/220

(58) Field of Classification Search ..... 2/69, 2/72, 74, 76, 211–214, 217, 219, 220, 221, 2/237

See application file for complete search history.

(56) References Cited

U.S. PATENT DOCUMENTS

| | | | | | |
|---|---|---|---|---|---|
| 1,031,112 | A * | 7/1912 | Fox | 2/211 |
| 1,139,881 | A * | 5/1915 | Malsin | 2/211 |
| 2,398,537 | A * | 4/1946 | Koret | 2/212 |
| 2,515,608 | A * | 7/1950 | Millman | 2/221 |
| 2,591,513 | A * | 4/1952 | Cormier | 2/74 |
| 2,898,601 | A * | 8/1959 | Presson | 2/211 |
| 3,002,193 | A * | 10/1961 | Briskman | 2/72 |
| 3,013,277 | A * | 12/1961 | Satin | 2/221 |
| 3,106,717 | A * | 10/1963 | Cuvin | 2/70 |
| 3,731,321 | A * | 5/1973 | Dyche | 2/211 |
| 3,793,645 | A * | 2/1974 | Kadison | 2/221 |
| 4,662,008 | A * | 5/1987 | Weiser | 2/211 |
| 5,173,965 | A * | 12/1992 | Panner | 2/105 |
| 5,265,778 | A * | 11/1993 | Shehebar | 223/28 |
| 5,327,586 | A * | 7/1994 | Evans et al. | 2/211 |
| 5,557,808 | A * | 9/1996 | Kawai | 2/211 |
| 5,566,393 | A * | 10/1996 | Best | 2/74 |
| 5,636,386 | A * | 6/1997 | Salamone | 2/247 |
| 5,771,494 | A * | 6/1998 | Ralston et al. | 2/211 |
| 5,802,619 | A * | 9/1998 | Ralston et al. | 2/220 |
| 5,806,100 | A * | 9/1998 | De Scandiffio | 2/211 |
| 5,983,392 | A * | 11/1999 | Dutka | 2/69 |
| 6,029,279 | A * | 2/2000 | Ralston et al. | 2/211 |
| 6,282,717 | B1 * | 9/2001 | Ng | 2/70 |
| 6,282,723 | B1 * | 9/2001 | Villegas | 2/211 |
| D503,513 | S * | 4/2005 | McCarthy | D2/735 |
| 2004/0216218 | A1 * | 11/2004 | McCarthy | 2/228 |

* cited by examiner

*Primary Examiner*—Alissa L. Hoey
(74) *Attorney, Agent, or Firm*—Zachary T. Wobensmith, III

(57) ABSTRACT

A pleated skirt is disclosed which includes a waistband assembly having a rear segment and two front segments, and a composite pleated skirt assembly having front, side, and rear pleats attached to the waistband assembly, an adjustable pleat at each side of the skirt to accommodate different wearer sizes, an inner front panel connected to a front segment of the waistband assembly, and an outer front panel connected to another front segment of the waistband assembly, snaps connected to the front panels to detachably connect them together, for attachment and detachment of the kilt from a wearer. The front inner panel has front pleats that step down incrementally, the front pleats and front inner panel are sewn together to create a funnel shape, and the outer panel has a plurality of stepped pleats. A plurality of hooks and loops of a cord are engageable with a rear pleat and the front panels for pulling the kilt together to provide a modesty system.

4 Claims, 5 Drawing Sheets

PLEATED SKIRT

BACKGROUND OF THE INVENTION

1. Field of the Invention

This invention relates to a pleated skirt, and more specifically to pleated kilts, of the type which includes provisions for adjusting the waist size, a modesty closure system, to reduce the wearer's exposure and an improved front apron snap system.

2. Description of the Prior Art

Pleated skirts are well known in the art, and have been worn by both men and women for hundreds of years. Pleated skirts such as kilts have become very popular in recent years, and increasing numbers of men are wearing them. Kilts are constructed of three basic parts. A kilt includes an over apron, which is the unpleated section of the front of the kilt, overlapping pleats or lines which form the back and sides of the kilt, and the under apron. The under apron is unpleated and fits under the over apron. The assembled kilt fits around the wearer's waist and thighs.

The prior art kilt shown in my prior U.S. Pat. No. 6,282,723 is a symmetrical kilt and provides many improvements over the prior art. The variations among individuals in their waist and hip structure require a number of different sizes of kilts to be manufactured. It is therefore desirable for a kilt to have provisions for waist adjustment, and particularly where the wearer does not wish to use a belt, and wants the kilt to snugly fit his waist, which adjustment feature the prior art kilts do not provide. In addition the nature of man's anatomy may produce a bulge in the front of the kilt, which some persons might find objectionable, however none of the prior art kilts have adequate provisions to hide the "manly bulge", while providing the desired comfort. In addition kilts are naturally open at the bottom, and if the wearer is riding a bicycle or engaging in other activity, which causes the kilt to "kick up", or to "open up" such as when sitting down, the resulting exposure can be embarrassing and is not addressed by the prior art kilts.

The kilt of my invention provides waist size adjustment, provides a modesty closure system, and disguises the "manly bulge", while enhancing the comfort of the wearer, without the shortcomings of the prior art kilts.

SUMMARY OF THE INVENTION

A pleated kilt is disclosed which includes a waistband having a plurality of pleats extending downwardly, which are partially attached to each other, and which overlap. The waist band is adjustable to accommodate waists of different sizes, by changing the exposed width of two adjustable floating pleats. A modesty closure system to enhance the wearers protection from unwanted viewing is provided, which includes arrangements for connecting the front and rear kilt panels by a hook and loop system for standing and sitting positions. A front snap system is provided, which includes a plurality of snaps and front panels, which disguises the "manly bulge".

The principal object of the invention is to provide a pleated kilt which has provisions for waist size adjustment.

A further object of the invention is to provide a pleated kilt that has a modesty closure system, which reduces the exposure of the wearer in standing and sitting positions, and may provide a culotte type garment.

A further object of the invention is to provide a pleated kilt that disguises the "manly bulge" of the wearer.

A further object of the invention is to provide a pleated kilt that provides a highly finished appearance.

A further object of the invention is to provide a pleated kilt that does not require the use of a belt.

Other objects and advantageous features of the invention will be apparent from the description and claims.

DESCRIPTION OF THE DRAWINGS

The nature and characteristic features of the invention will be more readily understood from the following description taken in connection with the accompanying drawings in which.

Figure 1:
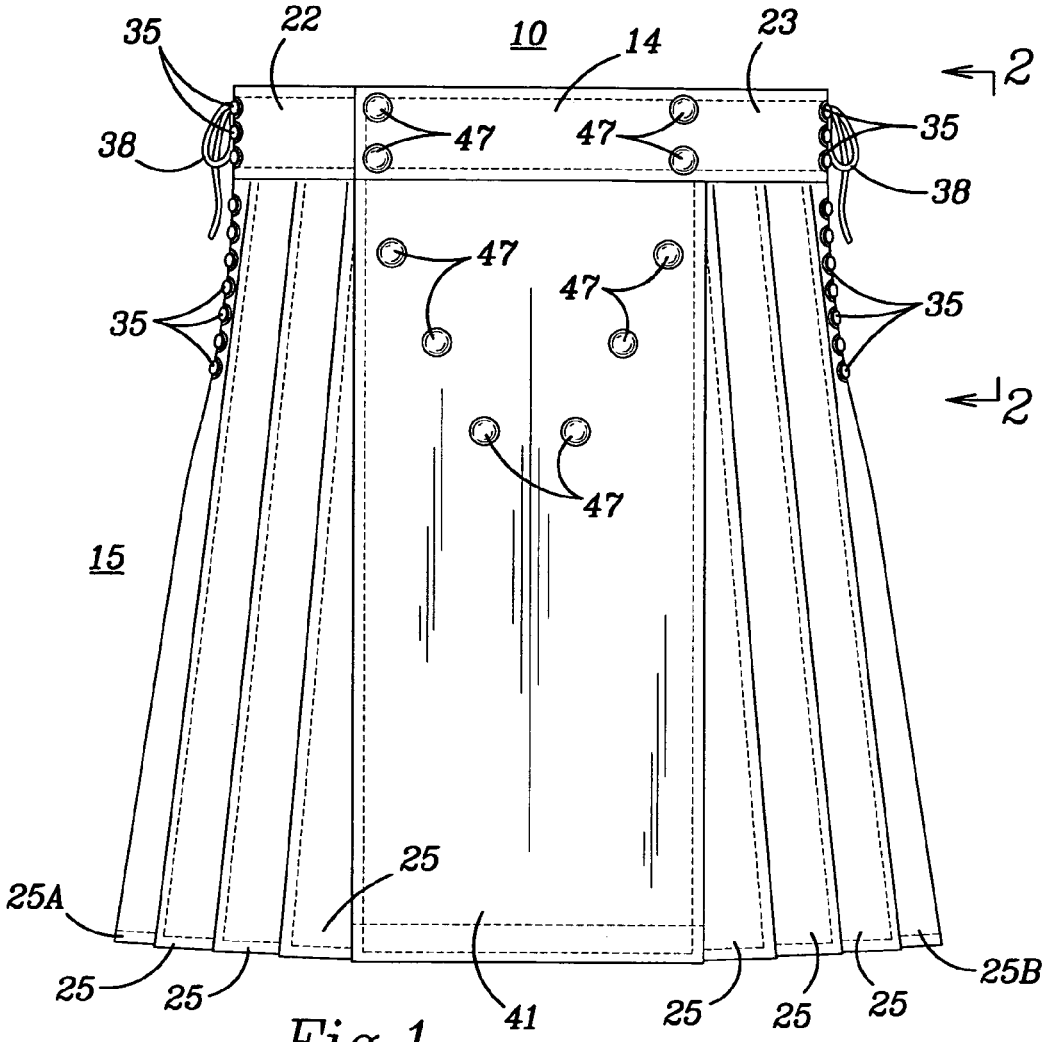
FIG. 1 is a front elevational view of one embodiment of the pleated kilt of the invention.
Figure 2A:
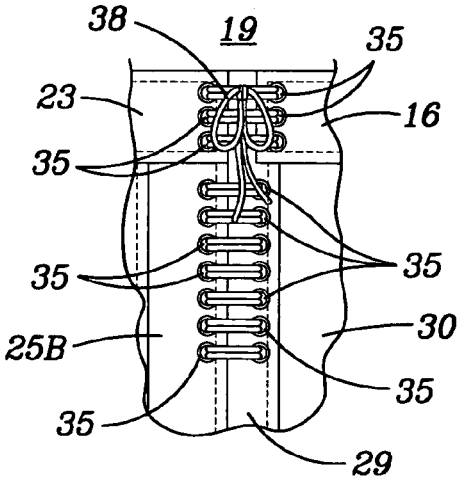
FIG. 2A is a partial side elevational view taken at the right side of FIG. 1 showing the adjustable waist feature in a tightened position.
Figure 2B:
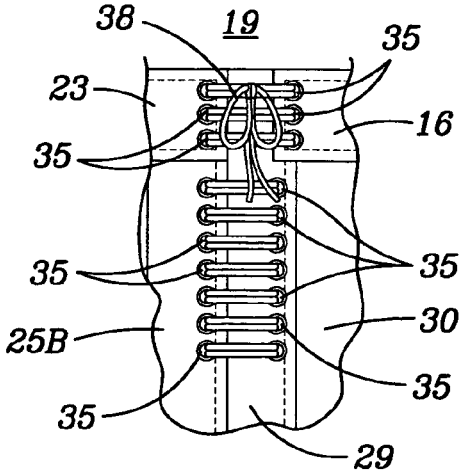
FIG. 2B is a view similar to FIG. 2A showing the adjustable waist feature in a loosened position.
Figure 2C:
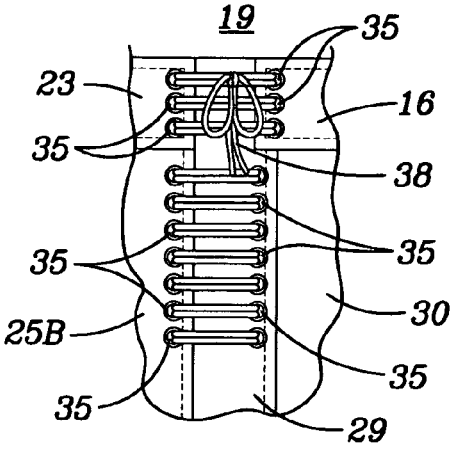
FIG. 2C is a view similar to FIG. 2B showing the adjustable waist feature in a greater loosened position.
Figure 2D:
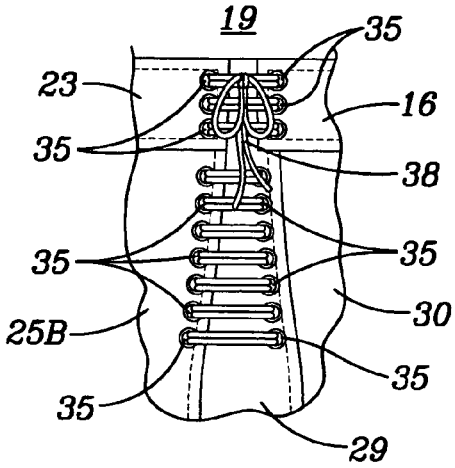
FIG. 2D is a view similar to FIG. 2C showing the adjustable waist feature in a still greater loosened position, the kilt of FIG. 2D is tighter on the waistband, looser around the hips.
Figure 3:
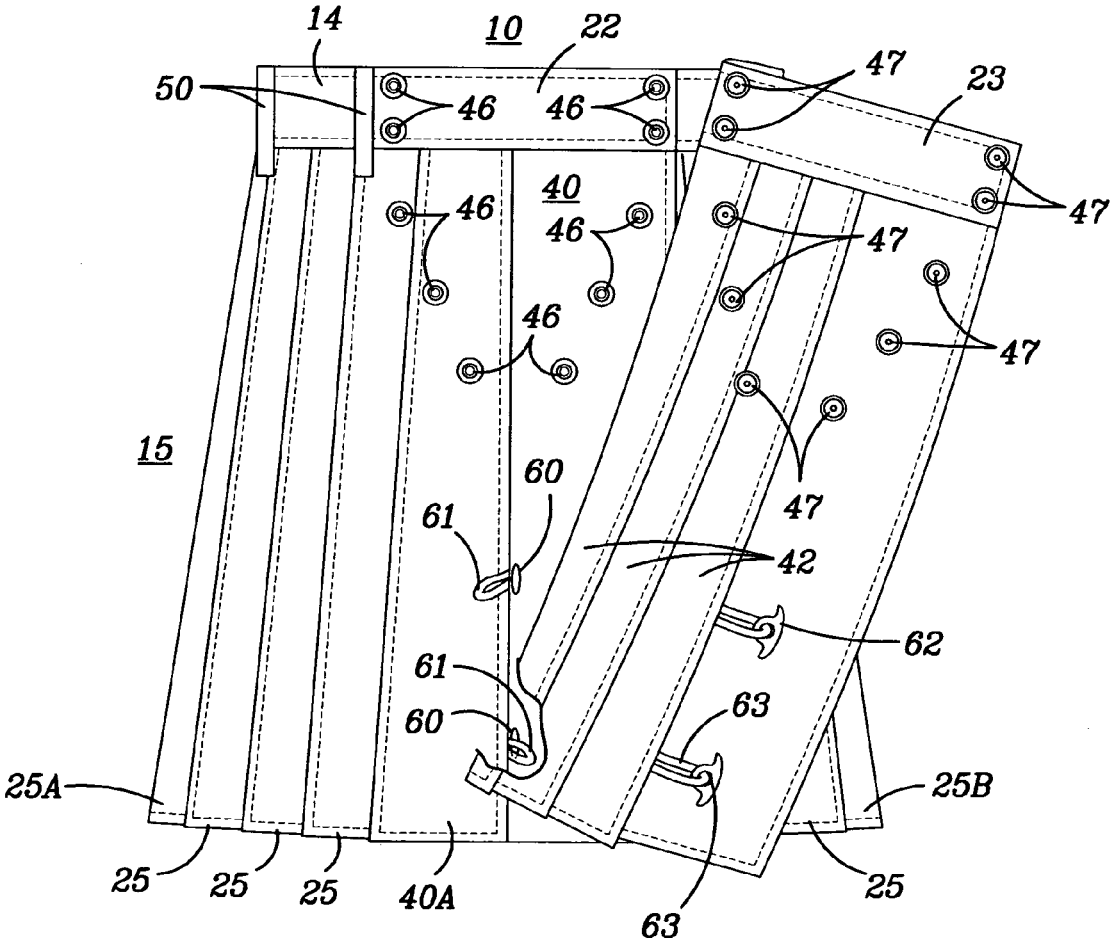
FIG. 3 is a front elevational view of the pleated kilt of FIG. 1 in an open position.

It should, of course, be understood that the description and drawings herein are merely illustrative and that various modifications and changes can be made in the structures disclosed without departing from the spirit of the invention.

Like numerals refer to like parts throughout the several views.

DESCRIPTION OF THE PREFERRED EMBODIMENTS

When referring to the preferred embodiments, certain terminology will be utilized for the sake of clarity. Use of such terminology is intended to encompass not only the described embodiments, but also technical equivalents, which operate and function in substantially the same way to bring about the same result.

Referring now to more particularly to FIGS. 1 to 3, 5, and 7–9 of the drawings, one embodiment of the pleated kilt 10 of the invention is therein illustrated. The kilt 10 can be constructed of any suitable material such as polyester, wool or other cloth, which is capable of withstanding the rigors of outdoor use, with leather being a particularly desirable material for many applications.

The kilt 10 includes a waistband assembly 14 and a composite skirt assembly 15. The waistband assembly 14 includes a rear segment 15 of the kilt 10, and which terminates at the sides 18 and 19 of the kilt 10. The waistband assembly 14 includes two front segments 22 and 23 which terminate respectively at the sides 18 and 19 of kilt 10, in spaced apart relationship to the rear segment 15. The segments 22 and 23 overlap in the front of the kilt to be described.

Figure 4:
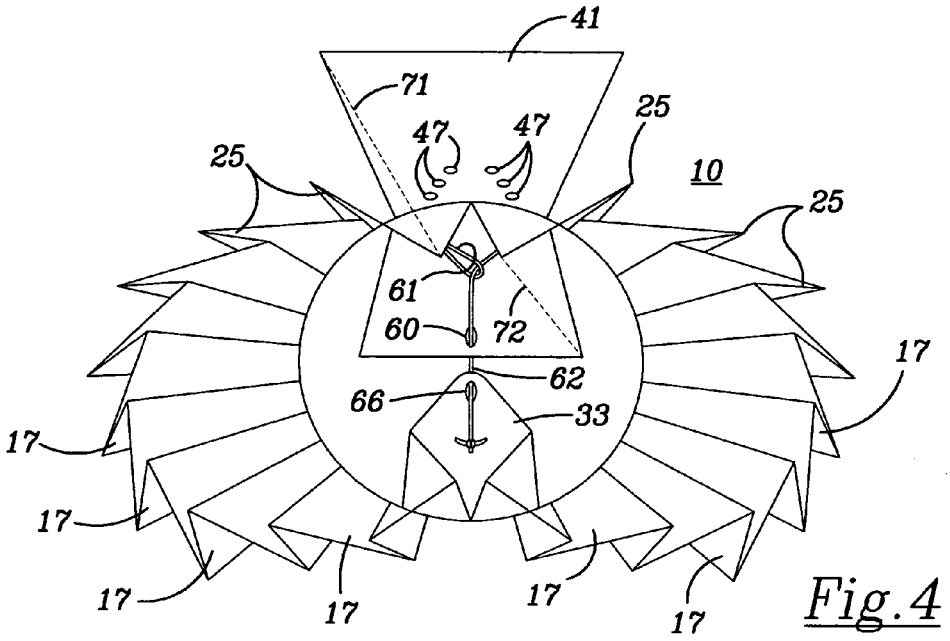
FIG. 4 is a bottom elevational view of the pleated kilt of the invention illustrating the modest closure system of the kilt.
Figure 5:
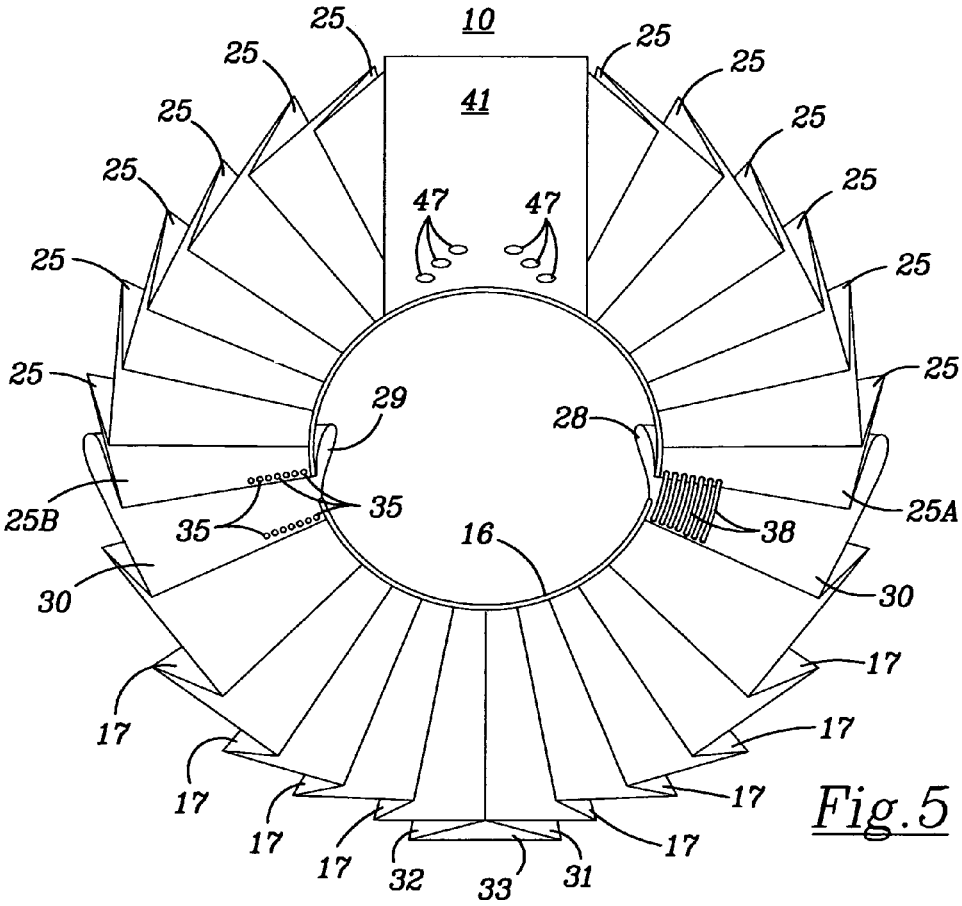
FIG. 5 is a top elevational view of the pleated kilt of the invention.
Figure 6:
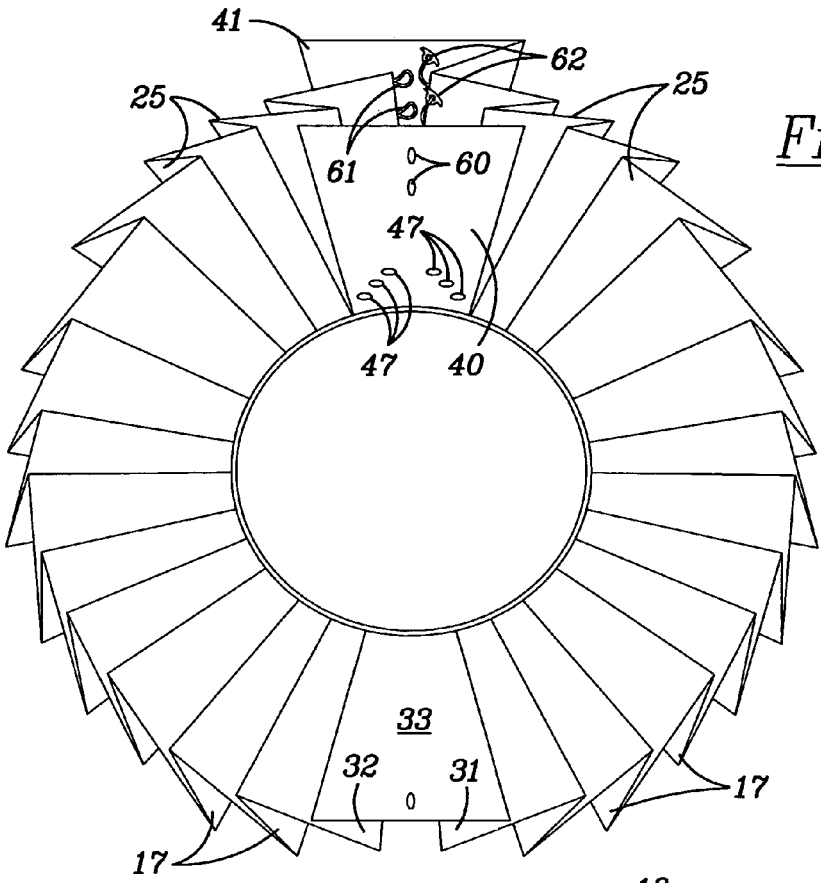
FIG. 6 is a bottom elevational view of the pleated kilt of the invention.
Figure 7:
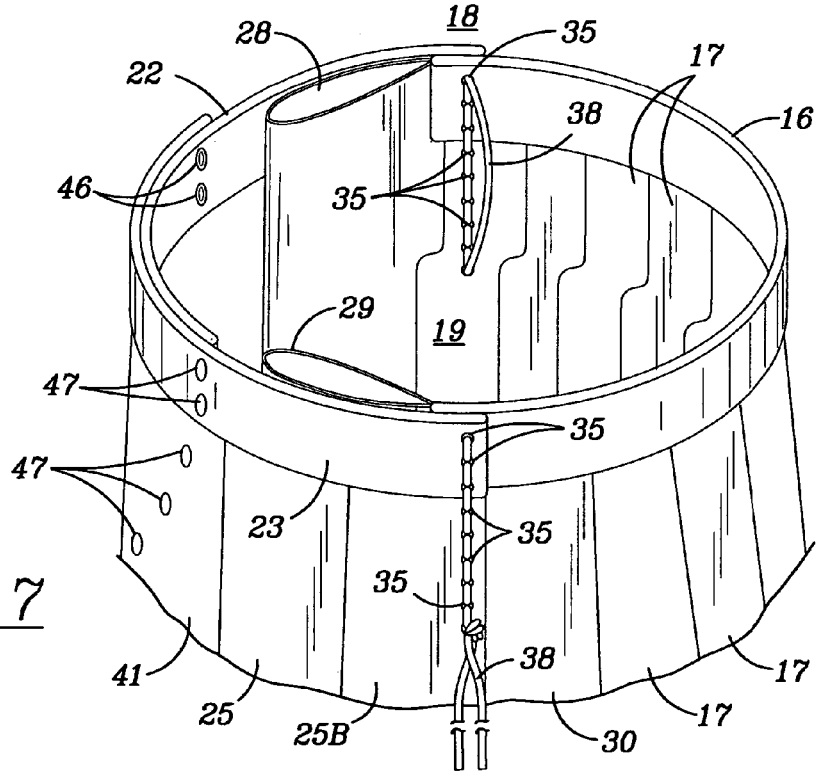
FIG. 7 is a partial perspective view of the pleated kilt illustrating the adjustable waist feature in a fully tightened position.
Figure 8:
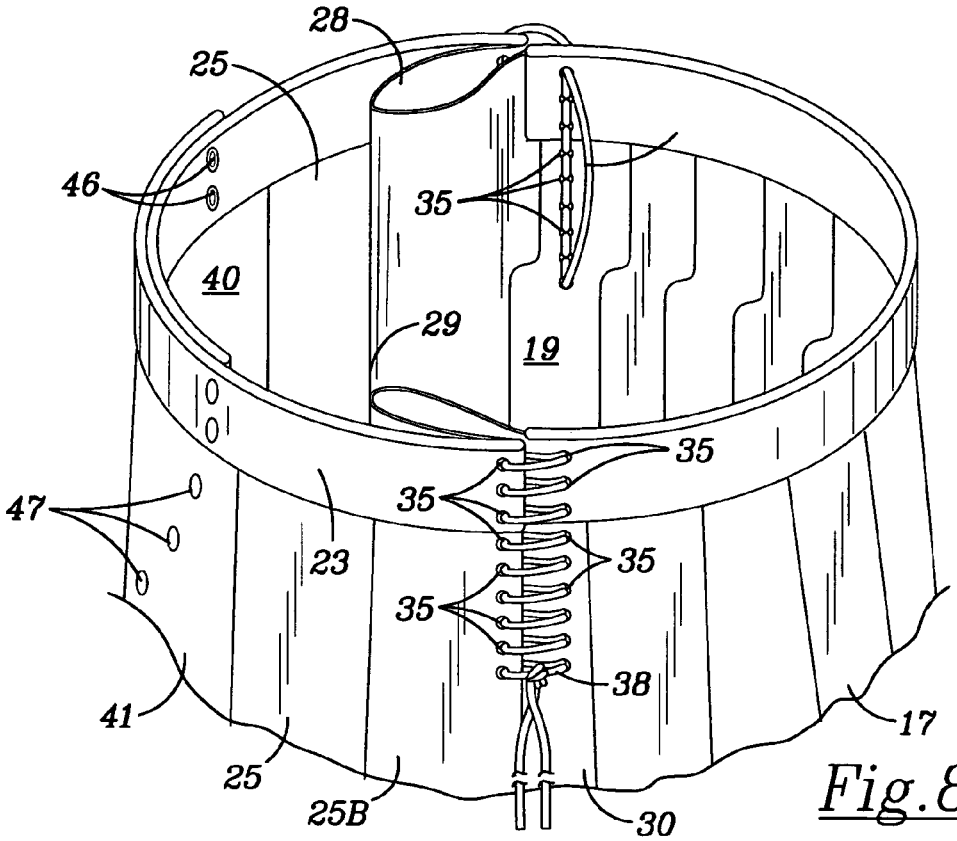
FIG. 8 is a view similar to FIG. 7 illustrating the adjustable waist feature in a loosened position.
Figure 9:
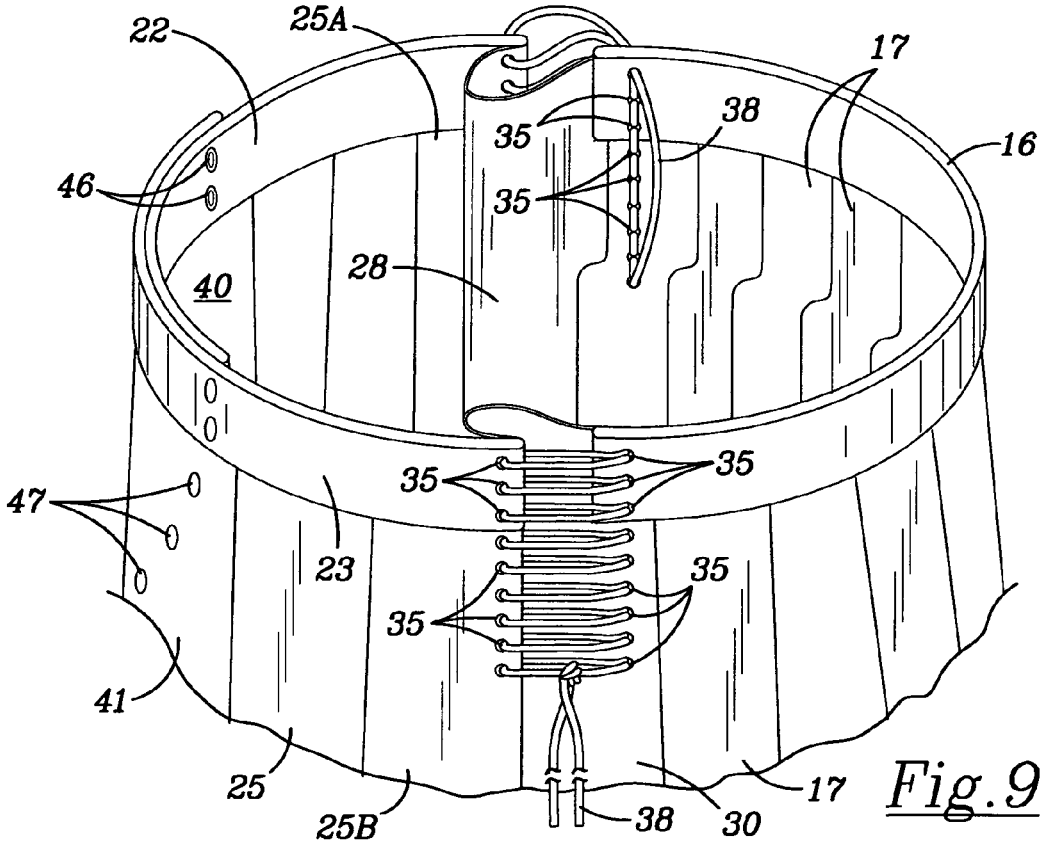
FIG. 9 is a view similar to FIG. 8 illustrating the adjustable waist feature in a greater loosened position.

The composite skirt assembly 15 has a plurality of pleats, which are formed by folding the kilt material, and pressing a sharp edge, or preferably by stitching together the folds of the material so that the fold or pleat lines extend across the length of the material from the waistband down to the bottom of the kilt. The composite skirt assembly 15 is secured to the waistband assembly 14 in well known manner such as by stitching. The composite skirt assembly 15 includes front pleats 25, 25A and 25B, four pleats being shown. Adjustable pleats 28 and 29 are provided at the sides 18 and 19 of kilt 10. The adjustable pleats 28 and 29 are respectively connected to a front pleat 25A or 25B, and to one of the rear pleats 30, and are overlapped by the pleats 25A, 25B and 30 to be described. Additional rear pleats 17 are provided, which are connected to the rearmost pleats 31, and 32, which have a pleat 33 connecting them together. The pleats 17, 25, 25A, 25B, 28, 29, 30, 31, and 32 are connected so as to form an accordion like pattern, as seen in FIGS. 4, 5, and 6, and as shown in my prior U.S. Pat. No. 6,282,723.

The front pleats 25A and 25B each have a plurality of vertically spaced eyelets 35 therein, along their edges, of well known type, seven being illustrated, the pleats 30 also have a plurality of vertically spaced eyelets 35 therein, seven being illustrated, in the same plane as the eyelets 35 in pleats 25A and 25B.

The front waistband segments 22 and 23 at the sides 18 and 19 have a plurality of eyelets 35 therein, spaced vertically, three being illustrated. The rear segment 16 at the sides 18 and 19 also has a plurality of eyelets 35 therein, three being illustrated, spaced vertically, in the same plane as the eyelets 35 of front segments 22 and 23. The eyelets 35 in waistband segments 22 and 23, and the eyelets in rear segment 16, have laces 38 therein holding them together. The eyelets in front pleats 25A and 25B, and pleats 30, have the laces 38 therein holding them together, and which overlap adjustable pleats 28 and 29. As seen particularly in FIGS. 2A, 2B, 2C, 2D, 7, 8, and 9 the laces 38 may be loosened or tightened to make the waistband larger, or smaller, to accommodate the wearer's (not shown) specific requirements. By loosening the laces 38 the exposed width of pleat 28 or 29 will expand, and by letting out the laces evenly the visual effect can be maintained. If the laces are fully loosened the kilt 10 will expand to create an open pleat 28 or 29, which is roughly twice the size of the pleat. The kilts 10 are graded differently depending on the size. The kilts may have pleat belt line widths as big as 4 &½ inches, and as small as ½ inch. The hipline width of the pleats may be as large as 6 &½ inches and as small as ¾ inch. For a kilt having a pleat belt line width of 1.6 inches, the hipline width is 2 inches. This sizing corresponds approximately to a size 35, and can be adjusted down to roughly a size 32, or expanded to a size 38.

The kilt 10 has an inner flat front panel 40, which is unpleated, connected to waistband segment 22, and may or may not be connected to pleat 25 by apron return 71. An outer flat front panel 41 is also provided which overlaps panel 40 when worn by a wearer. The panel 41 is connected to waistband segment 23, and may or may not be connected to pleat 25 by apron return 72. At the hipline of the kilt the pleats become open.

The waistband segment is provided with four snaps 46 and 47 to detachably fasten the panels 40 and 41 together around the waist of the wearer (not shown).

The kilt 10 as shown in FIG. 4 is also provided with a plurality of belt loops 50 which are spaced around the waistband 14.

Referring additionally to FIGS. 4, and 6, the kilt 10 is shown with a modesty closure system to reduce the potential exposure of the wearer (not shown) when sitting down or engaging in activity where the kilt 10 may fly up. In front panel 40 openings 60 are provided through which a loop 61 of a cord 62, elastic or solid as desired, can extend from rear pleat 33. The most forward pleat 25 is provided with hooks 63, which can engage the loop 61, and pull the kilt 10 together forming a bifurcated garment providing for comfort and modesty. For the standing position and lowermost loops 61 and the lowermost hooks 63 are adjoined, pushed through hole 60 on panel 40, and through hole 66 in rear panel 33. For the sitting position the uppermost loops 61 and the uppermost hooks 62 are engaged in similar fashion. This arrangement prevents the kilt from flying up, such as when riding a bicycle, or when struck by a gust of wind.

It will thus be seen that structure has been provided with which the objects of the invention are attained.

I claim:

1. A pleated skirt which comprises:

a waistband assembly for securing said skirt to the waist and hips of a wearer at a hipline of the skirt, a composite skirt assembly connected to said waistband assembly, and having a front, a back and sides, said waistband assembly having a rear segment, and two front segments, said front and said rear segments have eyelets therein at meeting segment ends at the sides of said skirt, and said waistband assembly, laces in said segment ends for connecting said segment ends together in adjustable size relationship to said waistband assembly, said composite skirt assembly has a plurality of pleats connected to and extending down from said waistband assembly, said pleats including front pleats, back pleats and adjustable side pleats at the sides of said skirt, eyelets in said pleats below said segment ends to receive said laces from said segment ends, for connecting said pleats together in adjustable size relationship to said composite skirt assembly, said skirt having a front inner panel connected to said one of said front pleats and said one of said waistband segments, said front inner panel having an additional panel sewn thereto and extending downwardly therealong, said skirt having a front outer panel connected to said other of said waistband segments and to one of said front pleats, said front outer panel has a plurality of pleats which extend down over the front outer panel reinforcing the panel, and said front inner and outer panels are detachably secured together by snap means.

2. A pleated skirt as defined in claim 1 in which said snap means includes snaps on said outer front panel, and mating snaps on said inner front panel.

3. A pleated skirt as defined in claim 1 in which said back pleat has at least one cord attached thereto, said cord has at least one loop, said front inner panel has a plurality of openings therein to receive said cord loop and said front outer panel has a plurality of hooks to selectively engage said cord loops to pull said panels together.

4. A pleated skirt as defined in claim 1 in which said waistband assembly has a plurality of belt loops.

* * * * *